US006336227B1

(12) United States Patent
Liput et al.

(10) Patent No.: US 6,336,227 B1
(45) Date of Patent: Jan. 8, 2002

(54) CONCEALED SOCK FOR BOAT-TYPE SHOES

(76) Inventors: Carolyn Liput; Deborah B. West, both of 719 St. Lucie La., Orlando, FL (US) 32807

( * ) Notice: Subject to any disclaimer, the term of this patent is extended or adjusted under 35 U.S.C. 154(b) by 0 days.

(21) Appl. No.: 09/660,164

(22) Filed: Sep. 12, 2000

(51) Int. Cl.[7] ..... A41B 11/00
(52) U.S. Cl. ..... 2/239
(58) Field of Search ..... 2/239, 240, 241, 2/242, 61, 409; 36/51; D2/903, 919, 920, 923, 924, 933, 934, 980, 981, 993

(56) References Cited

U.S. PATENT DOCUMENTS

| | | | | | |
|---|---|---|---|---|---|
| 832,550 | A | * | 10/1906 | Lepper | |
| 1,118,130 | A | * | 11/1914 | Hosmer | |
| 1,544,934 | A | * | 7/1925 | Prankard | |
| 2,219,235 | A | * | 10/1940 | Morton | 2/239 |
| 2,238,804 | A | | 4/1941 | Brown | |
| 2,333,373 | A | * | 11/1943 | Grey | 66/171 |
| 2,361,675 | A | * | 10/1944 | Atkins | 36/51 |
| 2,401,132 | A | * | 5/1946 | Boecker | 2/278 |
| 2,649,588 | A | | 8/1953 | Kantor | |
| D170,782 | S | * | 11/1953 | Wegner | D7/7 |
| 3,102,271 | A | * | 9/1963 | Wilkerson | 2/239 |
| 3,274,709 | A | * | 9/1966 | Lipinski | 36/10 |
| 3,315,276 | A | | 4/1967 | Daxe | |
| 3,417,408 | A | * | 12/1968 | Caggiano | 2/239 |
| 3,423,764 | A | | 1/1969 | Cassling | |
| 3,801,868 | A | * | 4/1974 | Bryant | 317/2 B |
| 4,106,126 | A | | 8/1978 | Traenkle | |
| 4,150,498 | A | * | 4/1979 | Palmer | 36/10 |
| 4,169,324 | A | | 10/1979 | Gibbs | |
| 4,187,619 | A | | 2/1980 | Gibbs | |
| 4,194,249 | A | * | 3/1980 | Thorneburg | 2/239 |
| 4,253,317 | A | * | 3/1981 | Howard et al. | 66/186 |
| D326,177 | S | * | 5/1992 | Miller et al. | D2/265 |
| D350,021 | S | * | 8/1994 | Stein | D2/969 |
| 5,337,493 | A | * | 8/1994 | Hill | 36/54 |
| 5,473,781 | A | * | 12/1995 | Greenberg | 2/239 |
| 5,499,459 | A | | 3/1996 | Tomaro | |
| 5,560,226 | A | * | 10/1996 | Throneburg | 66/185 |
| 5,603,232 | A | * | 2/1997 | Throneburg | 66/185 |
| 5,617,745 | A | * | 4/1997 | Della Corte et al. | 66/178 |
| 5,771,610 | A | * | 6/1998 | McDonald | 36/116 |
| 5,983,402 | A | * | 11/1999 | Fincher | 2/239 |
| 6,012,177 | A | * | 1/2000 | Cortinovis | 2/239 |
| 6,041,443 | A | * | 3/2000 | Pas et al. | 2/239 |
| 6,082,146 | A | * | 7/2000 | Dahlgren | 66/185 |
| 6,105,173 | A | * | 8/2000 | Brown | 2/239 |
| 6,173,589 | B1 | * | 1/2001 | Hayes, Jr. et al. | 66/171 |

* cited by examiner

*Primary Examiner*—John J. Calvert
*Assistant Examiner*—Alissa L. Hoey
(74) *Attorney, Agent, or Firm*—Edward M. Livingston, Esq.

(57) ABSTRACT

A concealed sock (1) for wearing with boat shoes (12) having a frontal section (2) and heel section (3) connected by an intermediate section (4 and 5). An elastomeric band runs around the top of the heel and intermediate sections to keep the sock concealed within the shoe. A second elastomeric band runs along the top front of the foot opening (13) in the intermediate section to keep the sock from rising up above the shoe. Pressure relief openings (9) on each end of the second elastomeric band further keep the sock concealed.

8 Claims, 1 Drawing Sheet

CONCEALED SOCK FOR BOAT-TYPE SHOES

BACKGROUND OF THE INVENTION

This invention relates to foot garments and more particularly to a sock to be worn which remains concealed during wear with low shoes, such as boat shoes, tennis shoes, athletic shoes, oxfords and so forth.

Boat and loafer-type shoes have become increasingly popular in recent years. However, a wearer's foot may sweat and thereby become slippery and uncomfortable to wear such shoes without socks, not to mention the resulting odor of the shoe due to the sweating. Unfortunately, conventional socks are visible above such shoes and do not look aesthetic, especially when one is wearing shorts. Athletic socks do not help much as they rise up above the shoes and are visible as well. As a result, people who like the comfort of such shoes do not wear them as often as they like to and those who do have to take them off more often in order to dry out their shoes.

Also, an increasing trend among young people when wearing tennis or athletic shoes is to disguise the sock for the "bare leg" look. Presently, the low socks on the market rise up and thus must be tucked under the heel and walked on to achieve this look.

Moreover, men as well as boys will not wear the low socks that are available due to the ballerina styling. Some believe it to be too feminine.

Thus, a need exists for a sock that can be worn with shoes which remains concealed and is comfortable during wear.

The prior art includes many socks, some of which have attempted to fulfill the above need but none have a structure like the present invention. For instance, U.S. Pat. No. 4,106,126, issued to Traenkle on Aug. 15, 1978, discloses a shoe sock having a height substantially the same as that of a shoe which uses hook and loop material to keep it in the shoe with the further assistance of a pompon. U.S. Pat. No. 2,649,588, issued to Kantor on Aug. 25, 1953, teaches a foot cap for wearing with a sock so as to conceal the sock by using an elastic rim and a frictional heel pad. U.S. Pat. No. 2,238,804, issued to Brown on Apr. 15, 1941, discloses a shoe sock that is secured around into a shoe by snaps and/or straps. U.S. Pat. No. 3,315,276, issued to Daxe on Apr. 25, 1967, discloses a concealed sock with a tab on the back that laps over the heel of the shoe to keep the sock in place. U.S. Pat. No. 5,499,459, issued to Tomaro, on Mar. 15, 1996, discloses a waterproof booty for a shoe which attaches inside the heel by using hook and loop fastening material. U.S. Pat. No. 3,423,764, issued to Cassling on Jan. 28, 1969, discloses a strap-like anchor for securing a sock in the proper position using adhesive means to attach the top of the sock to a leg. Finally, U.S. Pat. Nos. 4,187,619 and 4,169,324, issued to Gibbs on Feb. 12, 1980 and Oct. 2, 1979, respectively, teach a sock with a strap on the heel that folds over and attaches to the heel of a shoe to keep the sock in place.

Although the above inventions have attempted to solve the above problem, none have the same structure as the present invention and most require modification to the shoe itself in order to keep the sock concealed.

SUMMARY OF THE INVENTION

The primary object of the present invention is to provide a sock for wearing with boat and loafer-type shoes which remains concealed during wear.

Another object of the present invention is to provide such a sock which remains concealed without having to make modifications to the shoe itself.

Another object of the present invention is to provide such a sock that is comfortable to wear.

The present invention fulfills the above and other objects by providing a sock having three sections, a frontal foot section for covering the toes and the top and bottom of the front part of the foot, a heel section covering the bottom and side of a person's heel and an intermediate section connecting the frontal foot section to the heel section having a top opening for insertion of the foot. Two elastomeric bands provide the primary means for holding the sock within a boat shoe during wear. One elastomeric band runs along the top of the heel section and along a part of the top of the intermediate section and attaches to the top front of the intermediate section. A second elastomeric band runs along the front of the foot opening of the intermediate section to each side of the foot opening and connects near the front of the first elastomeric band. The two bands combine to keep the sock in place around the foot, below the top of the shoe and from rising up on the top front of the foot. The intermediate section may also have elastomeric material so the sock can stretch to accommodate different foot sizes. A pressure release opening on each side of the second elastomeric band may be used to keep the sock from rising up along the sides of the front of the foot. In order to further assist in the concealing of the foot the sock may have the same color as the boat shoe in which it is worn.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
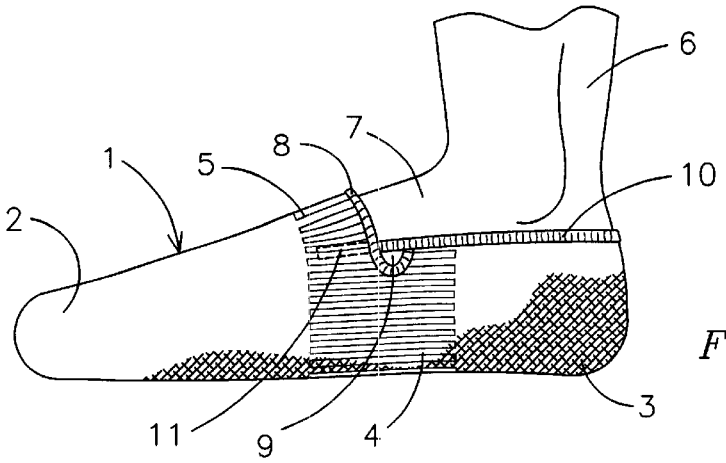
FIG. 1 is a side view of the sock of the present invention on a person's foot.
Figure 2:
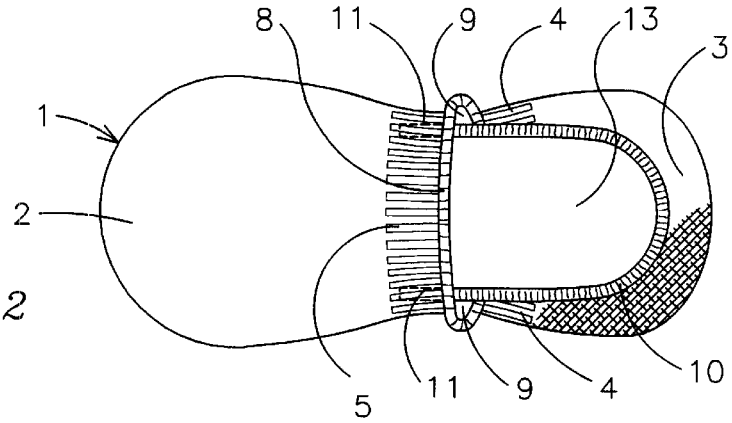
FIG. 2 is a top view of the sock by itself.

For purposes of describing the preferred embodiment, the terminology used in reference to the numbered components in the drawing Figures is as follows:

1. sock, generally
2. frontal section
3. heel section
4. bottom intermediate section
5. top intermediate section
6. leg
7. foot
8. second elastomeric band
9. pressure relief opening
10. first elastomeric band
11. anchor point side elastic
12. boat shoe
13. foot opening Referring to the drawings FIG. 1 shows the sock 1 on a person's leg and foot 6 and 7 and FIG. 2 shows the sock by itself. The sock has a frontal section 2 which covers the top front of the foot, toes and bottom front of a person's foot. A heel section 3 covers the back and sides and bottom of the heel. An intermediate section 4 connects the frontal section 2 and heel section 3 together.

A first elastomeric band 10 runs around the top of the heel section 3 and part of the intermediate section 4 and is connected at an anchor point 11. The front of the first elastomeric band 10 is connected at an anchor point 11 at the front of the intermediate section 4. This first elastomeric band keeps the sock around the heel and foot from rising above the sides of a boat-type shoe.

A second elastomeric band 8 runs along the front of the intermediate section 4 from side to side of the foot opening 13. The second elastomeric band 8 is secured at both ends near the front of the first elastomeric band 10 and may be straight or curved. The purpose of the second elastomeric band 8 is to keep the sock from rising up the front of the foot 7. If necessary a special pressure relief opening 9 on each end of the second elastomeric band 8 is helpful in keeping the sock down around the foot as without such a pressure relief point the second elastomeric band might pull too strongly upward on the front of the first elastomeric band 10 and risk exposing the sock outside the shoe.

The intermediate section 4 may also have some elastomeric material embedded in the cloth so that the sock may stretch in a longitudinal fashion to accommodate different sizes of feet.

Figure 3:
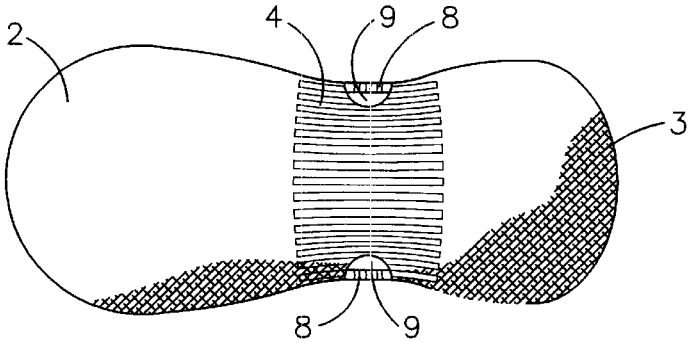
FIG. 3 is a bottom view of the sock by itself.

FIG. 3 shows the bottom of the frontal section 2 of intermediate section 4, heel section 3 as well as more clearly shows the pressure relief openings on each side of the second elastomeric band 8.

Figure 4:
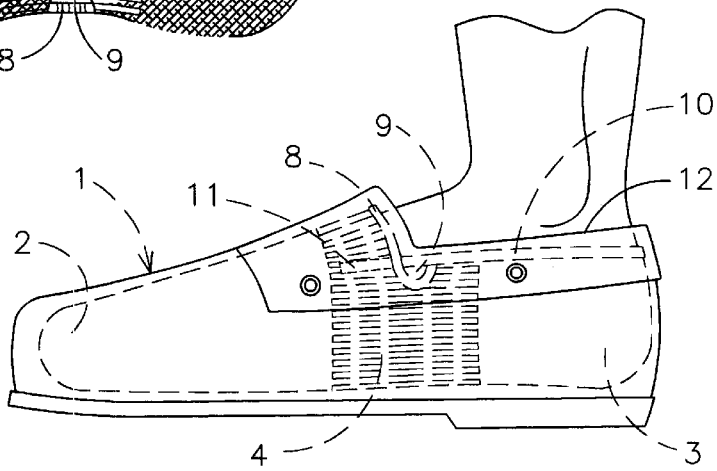
FIG. 4 is a side plan view of the sock while being worn with boat shoes.

FIG. 4 shows a boat-type shoe 12 with the sock 1 in plan view within the shoe to illustrate how the sock would fit well and remain concealed within the shoe.

Although the sock will remain concealed during wear, further concealment may be accomplished by making the sock of cloth which has the same or substantially similar color as the shoe with which it is being worn.

Although only a few embodiments of the present invention have been described in detail hereinabove, all improvements and modifications to this invention within the scope or equivalents of the claims are included as part of this invention.

Having thus described our invention, we claim:

1. A sock designed to be worn in a concealed fashion within a boat-type shoe, the sock comprising:

a frontal foot section for covering the toes and front of a foot;

a heel section covering a back, bottom and sides of a person's heel;

an intermediate section connecting the frontal foot section to the heel section of the sock, said intermediate section having a bottom and an opening on the top for insertion of the foot;

a first band of elastomeric material running along the top of the heel section and partially along both sides of the opening on the top of the intermediate section, said first band of elastomeric material being anchored on both sides at the top proximate the intermediate section at a front portion thereof; and a second band of elastomeric material running traversly along the sides of the opening and connected to the first band of elastomeric material, wherein both bands of elastomeric material are positioned so as to be concealed within the boat-type shoe.

2. The sock of claim 1 wherein the intermediate section is elastomeric in order that the sock can stretch to accommodate different foot sizes.

3. The sock of claim 2 wherein the intermediate section has a pressure relief opening approximately at each end of the second band of elastomeric material.

4. The sock of claim 3 wherein the sock is a same color as the shoe.

5. The sock of claim 2 wherein the sock is a same color as the shoe.

6. The sock of claim 1 wherein the intermediate section has a pressure relief opening on each end of the second band of elastomeric material.

7. The sock of claim 6 wherein the sock is a same color as the shoe.

8. The sock of claim 1 wherein the sock is a same color as the shoe.

* * * * *